US011072020B2

(12) United States Patent
Yang

(10) Patent No.: US 11,072,020 B2
(45) Date of Patent: Jul. 27, 2021

(54) SPRING MANUFACTURING MACHINE WITH SELECTABLE CONFIGURATION FOR PROCESSING TOOLS

(71) Applicant: PLUSPRINGS MACHINERY CO., LTD, New Taipei (TW)

(72) Inventor: Ching-Fa Yang, New Taipei (TW)

(73) Assignee: PLUSPRINGS MACHINERY CO., LTD, New Taipei (TW)

( * ) Notice: Subject to any disclaimer, the term of this patent is extended or adjusted under 35 U.S.C. 154(b) by 142 days.

(21) Appl. No.: 16/259,067

(22) Filed: Jan. 28, 2019

(65) Prior Publication Data

US 2020/0047239 A1 Feb. 13, 2020

(30) Foreign Application Priority Data

Aug. 10, 2018 (TW) ..... 107210989

(51) Int. Cl.
*B21F 35/02* (2006.01)
*B21F 3/02* (2006.01)

(52) U.S. Cl.
CPC ..... *B21F 35/02* (2013.01); *B21F 3/02* (2013.01)

(58) Field of Classification Search
CPC ..... B21F 3/00; B21F 3/02; B21F 3/04; B21F 1/00; B21F 1/008
USPC ..... 140/102, 103, 92.1; 72/135, 145
See application file for complete search history.

(56) References Cited

U.S. PATENT DOCUMENTS 3,934,445 A * 1/1976 Lampietti ..... B21F 3/02 72/129
5,203,191 A * 4/1993 Maggi ..... B21F 1/00 72/140
7,107,806 B2 * 9/2006 Tsuritani ..... B21F 3/02 72/135
8,302,443 B2 * 11/2012 Tsuritani ..... B21F 3/02 72/145
8,307,683 B2 * 11/2012 Jung ..... B21F 3/04 72/148
8,424,352 B2 * 4/2013 Jung ..... B21F 3/10 72/145
8,573,014 B2 * 11/2013 Tsuritani ..... B21F 3/02 72/145

(Continued)

OTHER PUBLICATIONS

Amrit, JYF High Speed Spring Coiling Machine: C6200 Bendwire (Year: 2017).*

*Primary Examiner* — Adam J Eiseman
*Assistant Examiner* — Bobby Yeonjin Kim
(74) *Attorney, Agent, or Firm* — Locke Lord LLP; Tim Tingkang Xia, Esq.

(57) ABSTRACT

The present invention provides a spring manufacturing machine including a wire guide member configured to guide a wire along a conveying direction to a first base point or a second base point for forming a spring, and a pair of movable assemblies configured to allow the second base point to be located between the first base point and the pair of movable assemblies. Each of the movable assemblies comprises a mounting platform configured to move close to or away from the first base point or the second base point along the conveying direction. Each mounting platform has a recess, and two mounting platforms are adjacent to each other to allow their respective recesses to surround the second base point, so that the movement of the mounting platforms do not to interfere with operation at the second base point.

8 Claims, 10 Drawing Sheets

(56) References Cited

U.S. PATENT DOCUMENTS

| | | | | |
|---|---|---|---|---|
| 9,796,013 | B1 * | 10/2017 | Yang | B21F 1/008 |
| 2002/0108419 | A1 * | 8/2002 | Itaya | B21F 3/02<br>72/137 |
| 2008/0302156 | A1 * | 12/2008 | Itaya | B21F 3/02<br>72/135 |
| 2011/0114217 | A1 * | 5/2011 | Wu | B21F 35/00<br>140/71 C |
| 2014/0311204 | A1 * | 10/2014 | Sigg | B21F 3/06<br>72/139 |
| 2015/0075244 | A1 * | 3/2015 | Itaya | B21F 3/12<br>72/135 |
| 2016/0332212 | A1 * | 11/2016 | Yang | B21F 1/008 |

* cited by examiner

SPRING MANUFACTURING MACHINE WITH SELECTABLE CONFIGURATION FOR PROCESSING TOOLS

CROSS-REFERENCE TO RELATED APPLICATIONS

This application claims priority to Taiwan Application Serial Number 107210989, filed on Aug. 10, 2018, which is incorporated by reference herein in its entirety.

BACKGROUND OF THE INVENTION

Field of the Invention

The present invention relates to a spring manufacturing machine, and more particularly to a spring manufacturing machine with a selectable configuration for processing tools.

Description of the Prior Art

Nowadays, assembly of the parts of a spring manufacturing machine is mainly contingent upon the type of spring to be formed; a plurality of processing tools are decided according to the spring type and mounted on the base respectively. Generally, spring manufacturing machines use cams as a means to drive the processing tools, so that they will cooperate with each other in the process of manufacturing springs. However, current designs of the base in these machines limit the possible purchase orders that a spring manufacturing machine can manage. For example, as far as the assembly of different parts of an existing spring manufacturing machine is considered, the space configuration for processing tools in the machine is basically designed based on the type of spring to be formed. Generally, the processing tools do not have a modular design and are arranged in an approximately radial manner to point to a wire guide member. Moreover, using a fixed program to arrange the movement of spring processing tools on the base makes an existing spring manufacturing machine to be able to produce one type of spring only. Once there are demands for making different types of springs, the processing tools configured on existing spring manufacturing machines need to be redesigned. When the complexity of a spring structure increases or when mixed types of springs need to be processed and manufactured, the number of processing tools to be used will increase. In consequence, it will not be easy to arrange the mounting locations for the processing tools in order to allow them to operate in a movable working space (including horizontal and vertical movement) without interfering with one another. This will remain a difficult problem for existing spring manufacturing machines. Therefore, using existing spring manufacturing machines is disadvantageous to manufacturing processes that involve multiple types of springs in small quantities or mixed types of springs. In addition, existing spring manufacturing machines cannot meet future demands for intelligent manufacturing in industry 4.0.

In view of the above, to enhance the efficiency and convenience in using spring manufacturing machines, developing a machine with a design of different mounting platforms can surely meet the needs of the industry.

SUMMARY OF THE INVENTION

An object of the present invention is to provide a spring manufacturing machine which has a mounting surface for mounting processing tools. The spring manufacturing machine includes a wire guide member and a pair of movable assemblies. The wire guide member is configured to guide a wire along a conveying direction to a first base point or a second base point, which are located on the mounting surface for forming the spring. The pair of movable assemblies are configured on the mounting surface in a manner that allows the second base point to be located between the first base point and the pair of movable assemblies. Each of the pair of movable assemblies includes a mounting platform configured to move close to or away from the first base point or the second base point along the conveying direction. Each mounting platform of the pair of movable assemblies includes a recess, and the two mounting platforms are adjacent to each other to allow their respective recesses to surround the second base point, so that the movement of the mounting platforms does not interfere with operation at the second base point.

In one embodiment, the first base point and the second base point are located along the conveying direction, and the first base point and the second base point do not overlap.

In one embodiment, the two movable assemblies are arranged symmetrically with respect to the conveying direction of the wire guide member.

In one embodiment, the mounting platform includes a front end, a rear end opposite to the front end, and an inner end extending between the front end and the rear end. The recess connects between the front end and the inner end, and the inner ends of the two mounting platforms are adjacent to each other. The recess includes a first edge and a second edge; the first edge of the recess extends from the front end in a direction parallel to the conveying direction, and the second edge of the recess extends from the inner end in a direction perpendicular to the conveying direction.

In one embodiment, the second base point is located between the recesses of the mounting platforms.

In one embodiment, the mounting platforms provide a plurality of mounting sections to allow processing tools to be mounted thereon selectively.

In one embodiment, the mounting platform includes a positioning groove for mounting processing tools. The positioning groove extends between the front end and the inner end of the mounting platform. The positioning groove has a turning point, which defines sections of the positioning groove that extend in different directions.

DETAILED DESCRIPTION OF THE PREFERRED EMBODIMENTS

Figure 1:
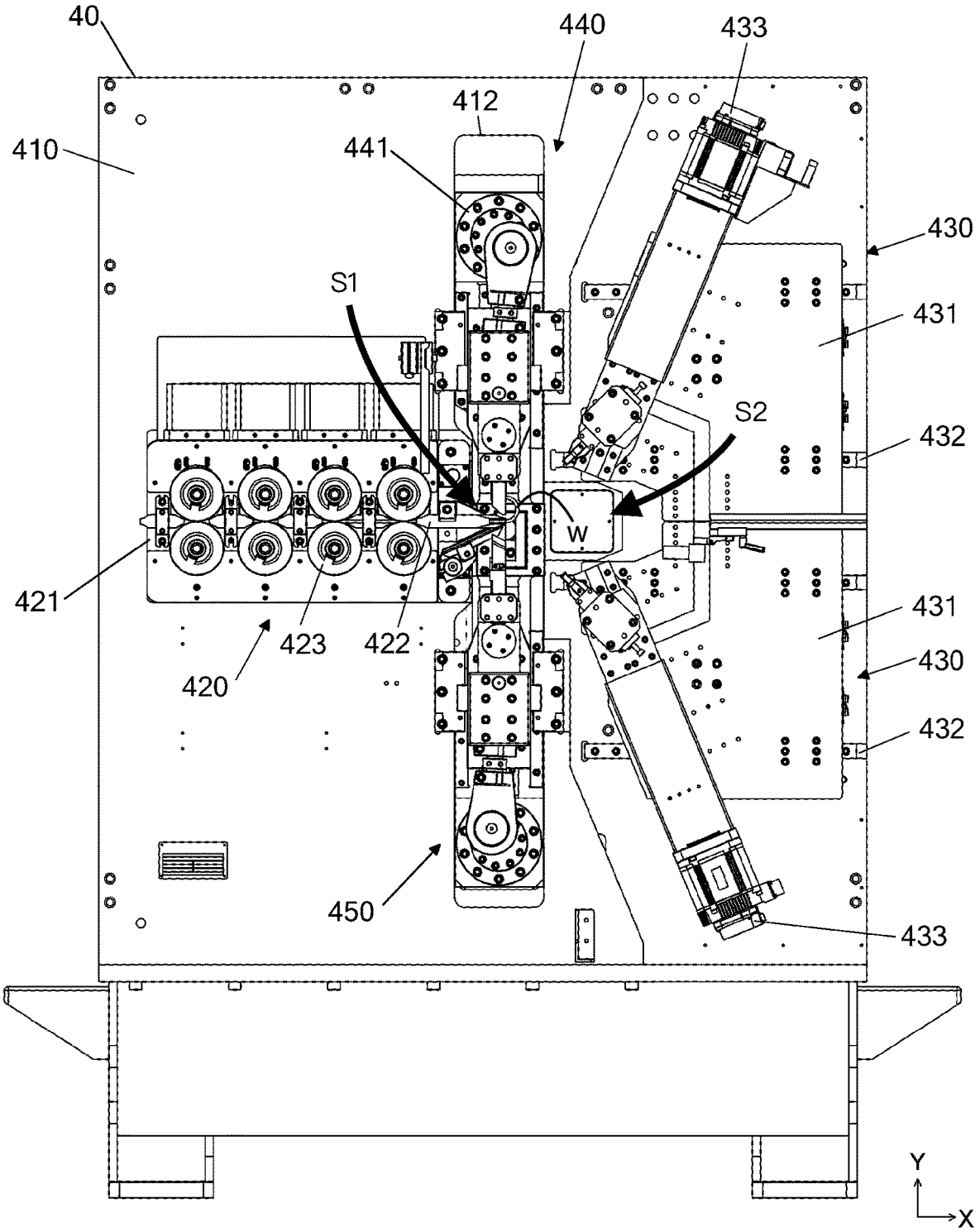
FIG. 1 is a front view of a spring manufacturing machine according to one embodiment of the present invention.

The following provides an ample description of the present invention with reference to the appended drawings which illustrate exemplary embodiments according to the present invention. However, the present invention can be embodied in various different forms and should not be limited to the embodiments described herein. On the contrary, these embodiments are provided to fully describe the present invention and to demonstrate to those skilled in the art so that they can comprehensively appreciate the scope of the present invention.

The terms used herein have the general meanings pertaining to the technique, the content of the present invention and the specific context where each term is used. Certain terms used to describe the present invention are discussed below or elsewhere in the description with an aim to provide practitioners with additional instructions on the description of the present invention. What should be noted is, the same technical feature or condition may be expressed in more than one ways. Therefore, any one or more of the terms discussed herein may be expressed in substitute terms and synonyms; none of the substitute terms or synonyms used have any particular meaning regardless of whether the terms are described or discussed in detail herein. Some terms include synonyms, and using one or more synonyms does not exclude the use of other synonyms. Any example used in this description (including examples related to any terms discussed herein) is for explanation purposes only and does not intend to limit the scope of the present invention or the meaning of any exemplary terms. Similarly, the present invention is not limited to the various embodiments provided herein.

Unless expressly provided otherwise in the context, the following terms used throughout the specification and the claims have definite and relevant meanings as stated below. Unless specifically explained otherwise, the word "or" has an inclusive meaning and is equivalent to "and/or." Unless specifically explained otherwise in the context, the term "based on" shall not be construed as exclusive but shall mean that multiple other factors not described herein are also possible. Besides, throughout the entire specification, articles such as "a", "an" and "the" include both singular and plural referents. The expression "in . . . " includes the meaning of "in . . . " and "on . . . ."

In addition, terms expressing relative meanings, such as "lower" or "bottom," "upper" or "top," and "left" or "right," are used herein to describe the relative position of one element with respect to another as shown in the drawings. What should be understood is, aside from the orientations illustrated in the drawings, these terms are intended to cover different orientations related to the device. For example, when a device in a drawing is shown in a reverse view, an element originally described as on the "lower" side of another element may turn out to be on the "upper" side of that other element. Therefore, in accordance with the specific orientations shown in the drawings, the expression "lower" may be exemplary and encompass orientations described as "lower" or "upper." Similarly, when a device in a drawing is shown in a reverse view, an element originally described as "below another element" or "under another element" may turn out to be "above that other element." Hence, expressions such as "below . . . " or "under . . . " may encompass orientations described as above or below certain element(s).

Figure 2:
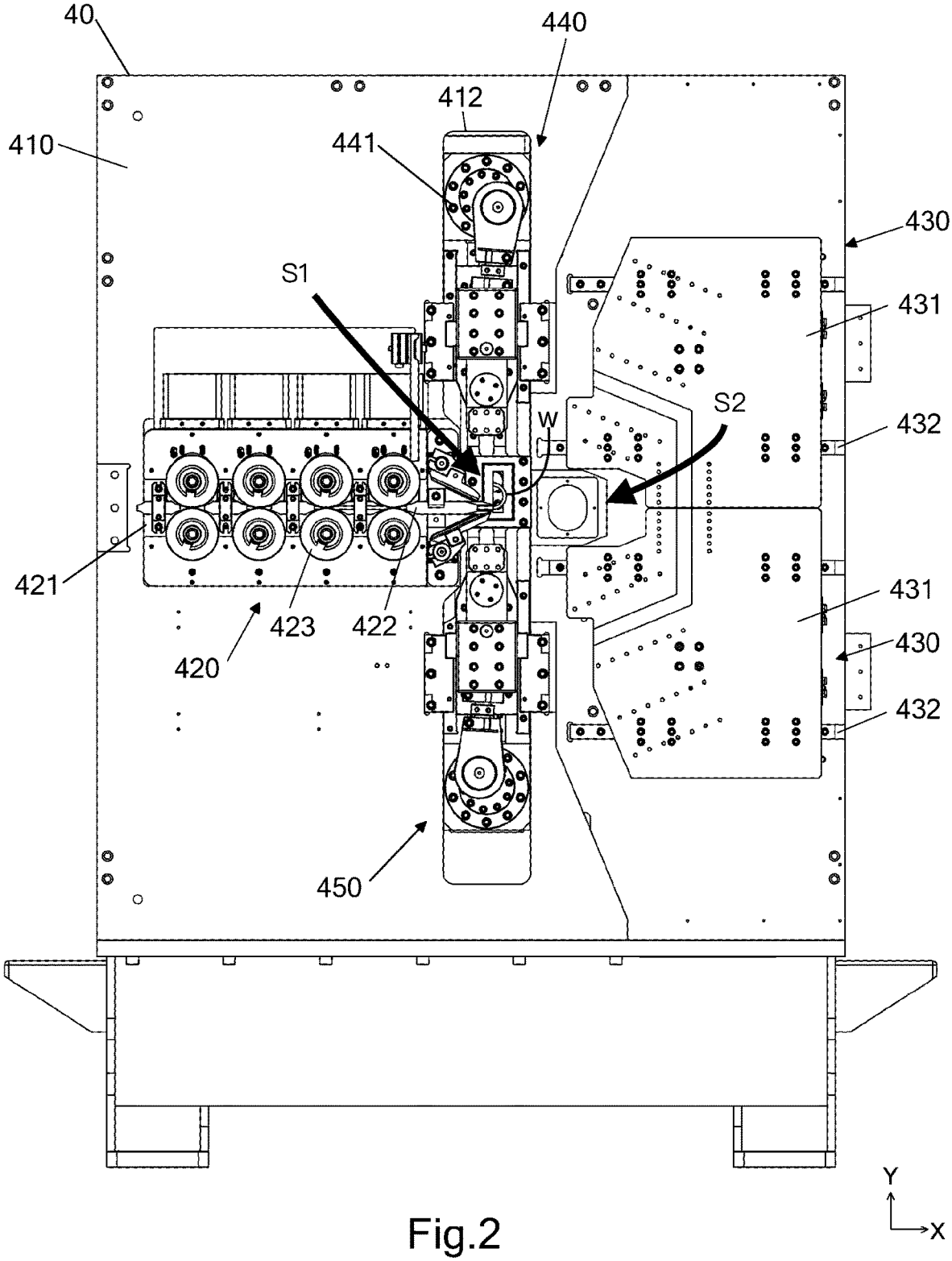
FIG. 2 is a front view of the spring manufacturing machine according to one embodiment of the present invention (with some processing tools removed).

FIGS. 1 and 2 illustrate an embodiment of a spring manufacturing machine according to the present invention, which can be used for producing helical springs or other similar products. The spring manufacturing machine comprises a machine body (40) having a length, a width and a height, thereby defining the six surfaces of the machine (only one surface is shown in the drawing). The machine body (40) is the main support structure of the spring manufacturing machine, and through proper design, a variety of processing tools and components can be installed and integrated into the body. FIG. 1 shows only one surface (or referred to as a mounting surface) of the machine body (40) where the processing tools and components for forming springs are configured. As for other components (such as the power system, central processing unit, power supply apparatus and transmission device) which are not the subject of the present invention, relevant descriptions are omitted here for brevity.

A part of a mounting surface (410) is properly configured to have a wire guide member (420) mounted thereon. The wire guide member (420) is used for guiding a wire (W) to move from the outside of the mounting surface (410) to the mounting surface (410) and then move along the mounting surface (410) to multiple base points (two base points S1 and S2 are shown in the drawings) for processing the wire (W). The base points (S1 and S2) are spaces located a short distance away from the mounting surface (410); for example, they may be situated at one or more positions where the wire (W) arrives after leaving the wire guide member (420). Each of these positions may cover a space, a point or multiple points where the processing tools make contact with the wire (W). The wire guide member (420) has an input end (421) coupled to a wire source unit and an output end (422) which is opposite to the input end (421) and near the base point positions. The wire guide member (420) comprises a plurality of roller sets (423) horizontally aligned between the input end (421) and the output end (422). The roller sets are driven by one or more drive units to move simultaneously at a uniform speed or rhythmically, so that the wire (W) is supplied to the base point (S1) in a horizontal direction (along the X-axis). The wire guide member (420) defines a wire conveying direction, which is substantially horizontal (e.g., the X-direction). The use of the wire guide member (420) in the embodiment is not limited to feeding wires; the wire guide member can be configured to supply other types of materials as well, such as metal bars or metal sheets.

A pair of movable assemblies (430) are provided on another side of the base point (S2), which is the side opposite to the wire guide member (420). The pair of movable assemblies (430) are substantially symmetrical with respect to the conveying direction defined by the wire guide member (420); that is, the movable assemblies (430) are located on the right side of the base points (S1 and S2) and consist of two separate components, the upper and lower movable assemblies, symmetrical to each other. If the base point (S1) is at the center of the mounting surface (410), then the wire guide member (420) is located on the left side of the mounting surface (410), and the movable assemblies (430) are located on the right side of the mounting surface (410).

Certainly, in other possible configurations, the positions of the two elements are interchangeable. Each of the pair of movable assemblies (430) includes a mounting platform (431) and a track unit (432). The mounting platform is in a flat shape and is slidably coupled to the mounting surface (410) by the track unit (432). The track unit (432) extends in a substantially horizontal direction (along the X-axis shown in the drawing), so that the mounting platform (431) can horizontally advance toward or retreat from the base point (S1 or S2). In other embodiments, each of the movable assemblies can include more mounting platforms and track units, and the track units can extend in other directions. Each of the mounting platforms (431) provides a plurality of mounting locations for mounting the processing tools. As shown in FIG. 1, each mounting platform (431) has a processing tool (433) mounted on it. FIG. 2 shows the exterior of the mounting platform (431) with the processing tools removed. The moving positions of each mounting platform (431) can be determined by a lateral coordinate (such as a coordinate on the X-axis shown in the drawing) defined by the track unit (432) and/or drive units.

Figure 3:
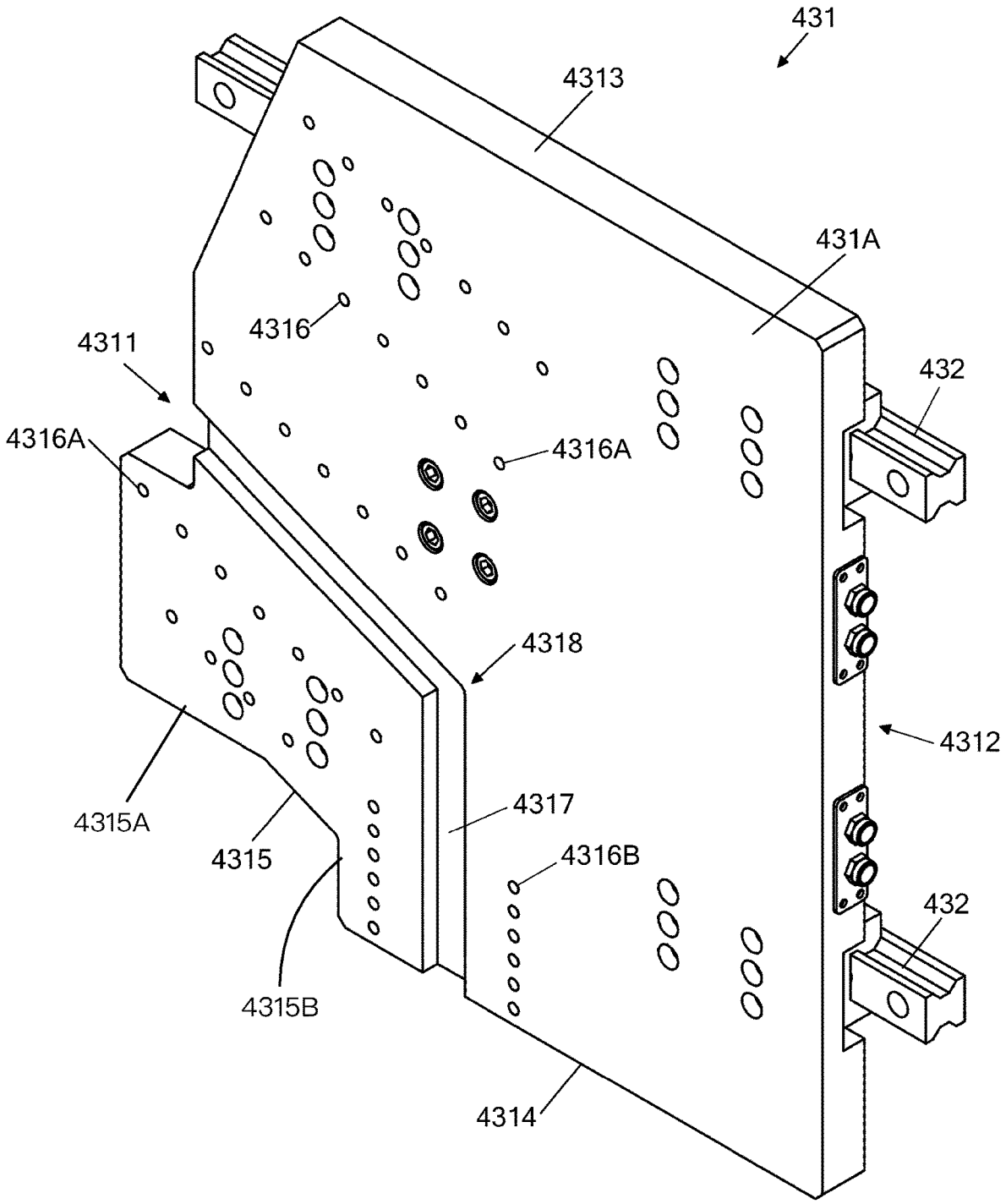
FIG. 3 is a perspective view of a mounting platform illustrated in FIG. 1.

FIG. 3 shows a perspective view of a front surface (431A) of an upper mounting platform (431). The mounting platform (431) has a front end (4311) and a rear end (4312) opposite to the front end (4311). The platform is a plate extending laterally between the front end (4311) and the rear end (4312), wherein the front end (4311) is near the base points. The mounting platform (431) further has an outer end (4313) and an inner end (4314); a recess is formed between the front end (4313) and the inner end (4314) and is configured to surround or avoid one of the base points. In the embodiment as shown in FIG. 3, the recess (4315) includes a first edge (4315A) and a second edge (4315B), with the first edge (4315A) extending from the front end (4311) substantially parallel to the wire conveying direction, and the second edge (4315B) extending from the inner end (4314) substantially vertical to the wire conveying direction. Though not shown in the drawings, a corresponding lower mounting platform has a configuration symmetrical to that of the upper mounting platform. Preferably, all the first and second edges (4315A and 4315B) of the upper and lower recesses define an area covering the base points. Certainly, in other possible embodiments, the recesses of the mounting platforms may be in different shapes. The front surface (431A) of the mounting platform has multiple mounting sections that provide multiple mounting locations for selection. The mounting sections or mounting locations are determined at least by a plurality of positioning holes (4316). The mounting locations can be determined based on the locations of the positioning holes (4316) relative to the lateral coordinate and/or an imaginary vertical coordinate (a coordinate on the Y-axis as shown in the drawing). A positioning groove (4317) is formed on the front surface (431A) of the mounting platform and extends between the front end (4311) and the inner end (4314). In another embodiment, the positioning groove (4317) can also determine the mounting sections or the mounting locations on the mounting platform. The positioning groove (4317) is slightly recessed from the front surface (431A) of the mounting platform. The positioning groove (4317) has a turning point (4318), which defines two different sections of the positioning groove (4317) extending in different directions, and thereby defines two mounting orientations. For example, on the mounting platform (431) illustrated in FIG. 3, the upper left and lower right portions with respect to the turning point (4318) are two mounting sections, respectively. In addition, the positioning holes can be grouped into an array of positioning holes (4316A) near the front end (4311) and another array of positioning holes (4316B) near the inner end (4314) with respect to the turning point (4318). An array of positioning holes (4316A) are aligned in a direction substantially parallel to the positioning groove (4317) near the front end (4311), and another array of positioning holes (4316B) are aligned in a direction substantially parallel to the positioning groove (4317) near the inner end (4314). Certainly, in other embodiments, the positioning holes and the positioning groove may have similar configurations, while more or fewer positioning holes or positioning groove may be provided on the mounting platform, Which may even comprise no turning point. Although only the upper mounting platform (431) is shown here, it should be understood that the lower mounting platform has a similar configuration as the two mounting platforms are arranged symmetrically.

Figure 4:
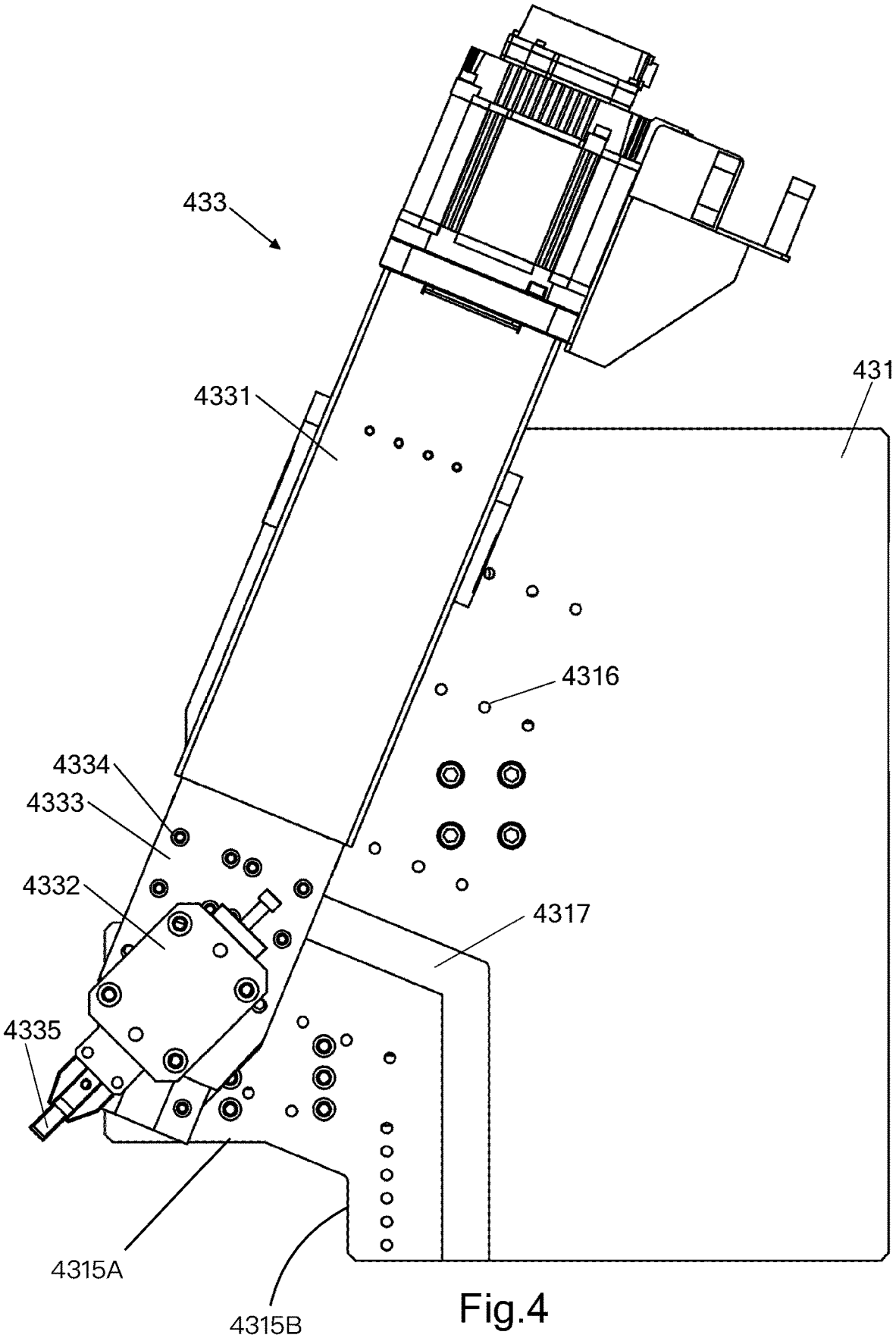
FIG. 4 is a front view of the mounting platform and a processing tool, both illustrated in FIG. 1.

FIG. 4 shows the upper mounting platform (431) with a processing tool (433) mounted on one of its mounting locations. The processing tool (433) mainly comprises a structural arm (4331) and a processing member (4332). The structural arm (4331) is secured into the positioning holes (4316) on the surface of the mounting platform (431) near the front end (4311) by known means and extends across the positioning groove (4317). The processing member (4332) is removably mounted on a mounting surface (4333) of the structural arm (4331) by known means. As the FIG. 4 shows, similarly, a plurality of positioning holes (4334) are arranged on a portion of the structural arm (4331), thereby providing multiple mounting locations for mounting the processing member (4332). The processing member (4332) holds a winding pin (4335) for forming the structure of a spring; the winding pin is configured to point at a base point. The winding pin (4335) is used for winding process of a wire that is in the forwarding direction. Thus, it can be known that based on the location of the mounting platform (431) on the track unit (432), the location of the processing tool (433) on the mounting platform (431), and the location of the processing member (4332) on the structural arm (4331), the relative position of the winding pin (4335) with respect to the base point can be determined. Although it is not shown in FIG. 4, the structural arm (4331) can include a stretching means by which the winding pin (4335) can advance toward or retreat from the base point. As for the processing tool mounted on the lower mounting platform, it has a configuration symmetrical to that of the processing tool described above, as shown in FIGS. 7A and 7B.

Figure 5:
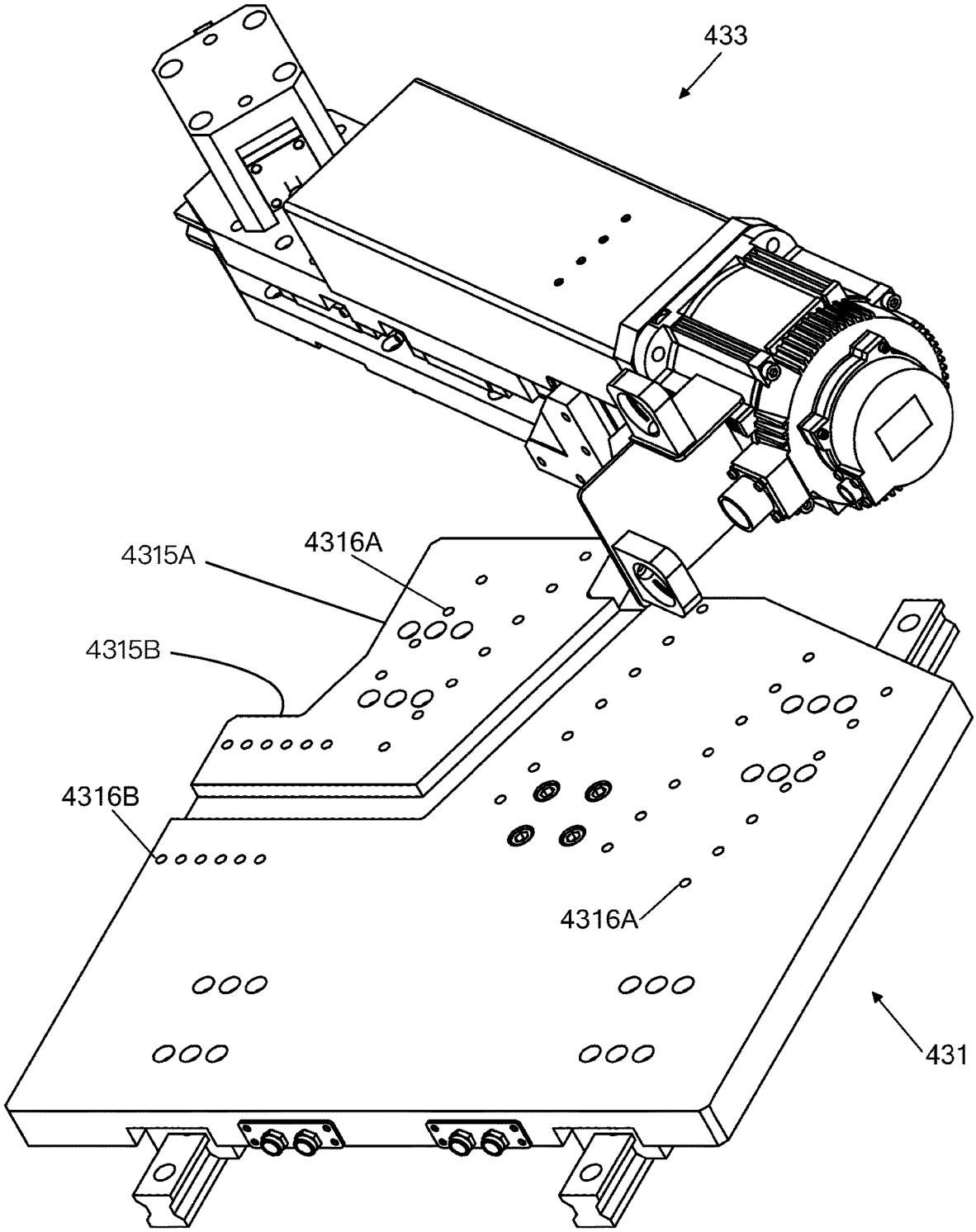
FIG. 5 shows the mounting platform and the processing tool illustrated in FIG. 1.
Figure 6:
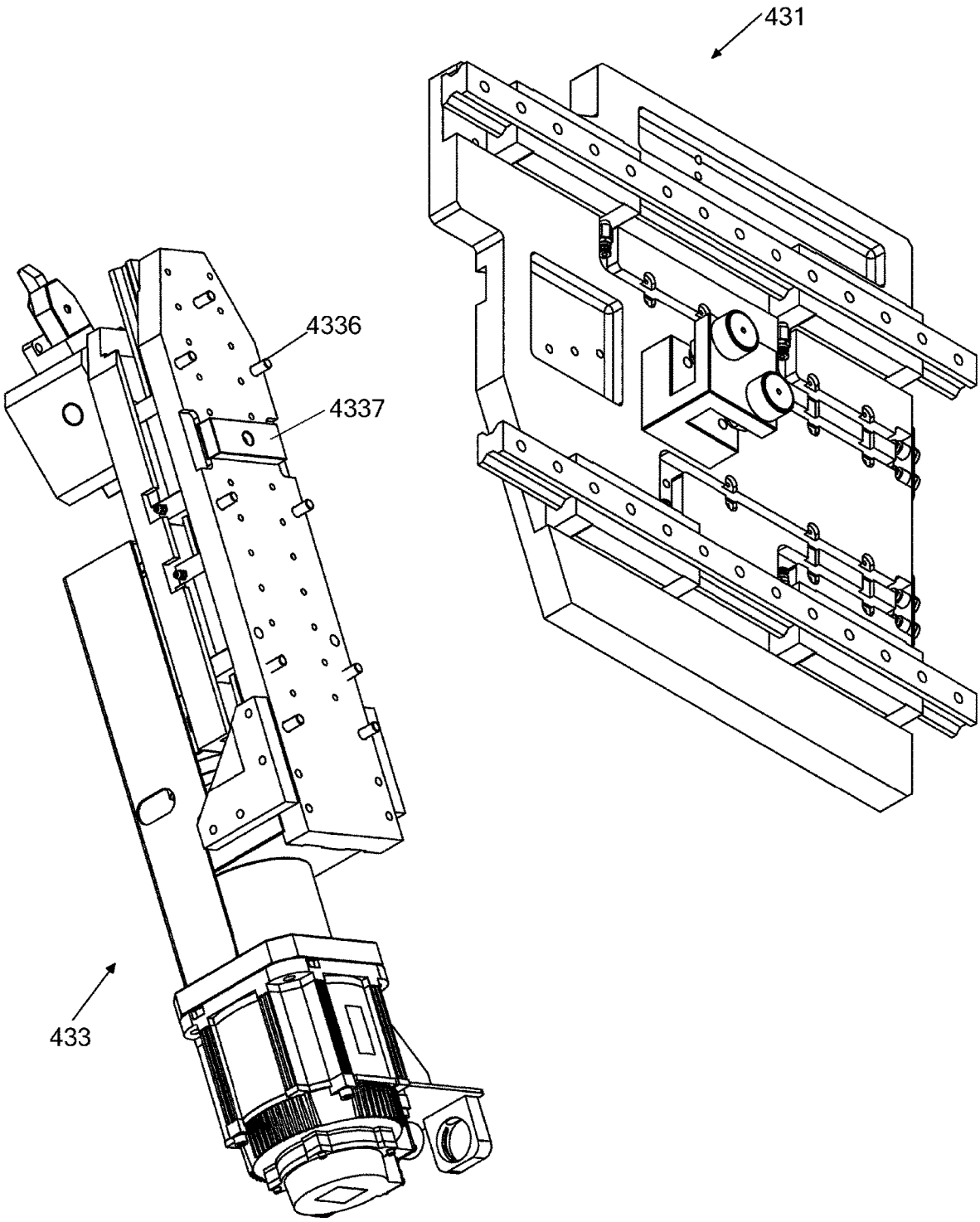
FIG. 6 shows the mounting platform and the processing tool illustrated in FIG. 1 (from another perspective).
Figure 7A:
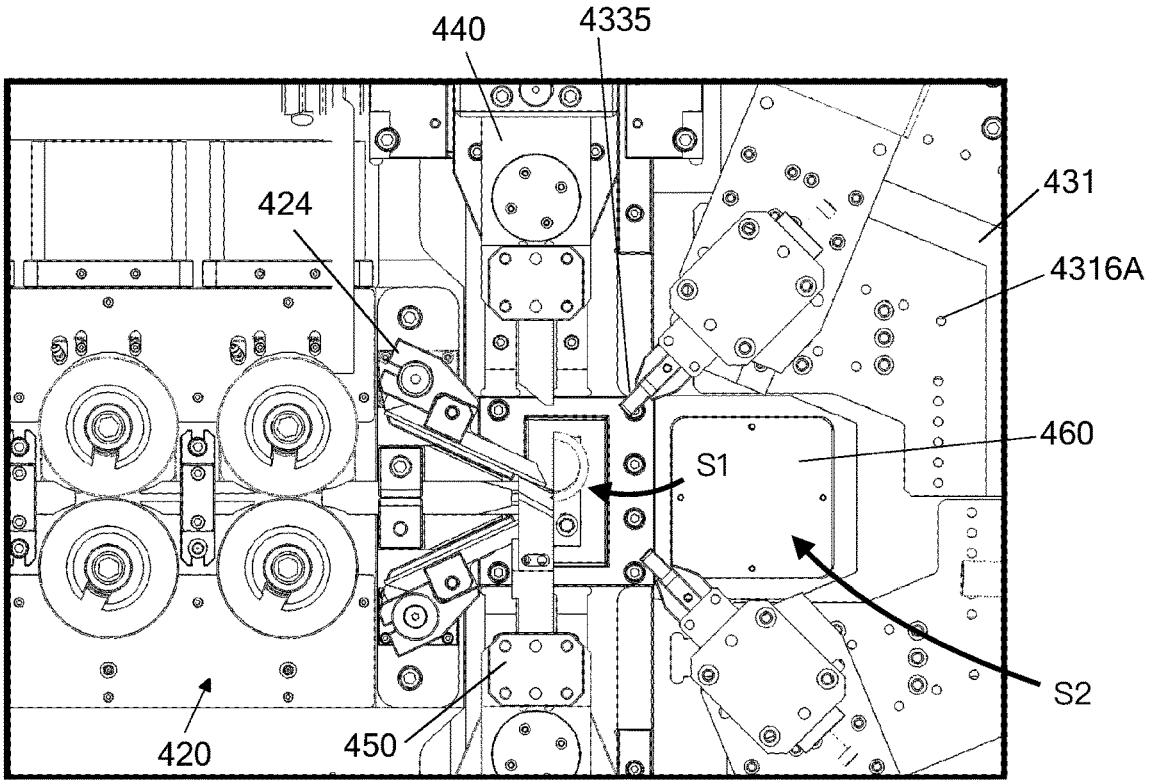
FIGS. 7A and 7B show the processing tools keeping away from and proceeding to a base point on the spring manufacturing machine, respectively.
Figure 7B:
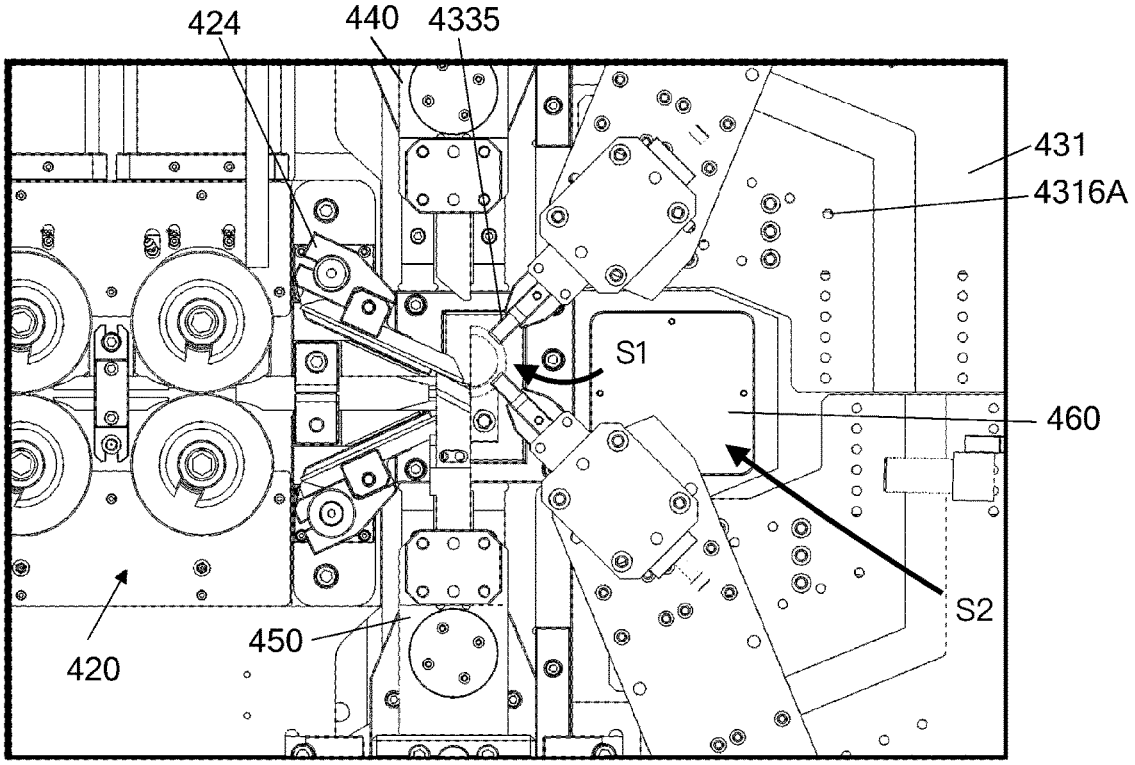

FIGS. 5 and 6 show two views, from different perspectives, of the upper mounting platform (431) and the processing tool (433) that is yet to be mounted. The positioning holes (4316A) near the front end (4311) of the mounting platform (431) and the positioning groove (4317) determine the mounting orientation of a processing tool (433), allowing the processing tool (433) to be secured onto the mounting platform (431) obliquely with respect to the wire conveying direction. As shown in FIGS. 7A and 7B, the upper and lower processing tools (433) forms a certain angle with respect to the wire conveying direction. FIG. 6 shows that elements at the bottom part of the processing tool (433) extend from a bottom surface; those elements include a plurality of positioning pins (4336) and a positioning block (4337). The positioning pins (4336) are configured to be inserted into the corresponding positioning holes (4316) on the mounting platform (431), and the positioning block (4337) is configured to match with the positioning groove (4317) on the mounting platform (431). Certainly, in other embodiments, the processing tools can be mounted by other means.

Referring back to FIGS. 1 and 2 again. The spring manufacturing machine according to the present invention is also equipped with a cutting arm (440), which generally includes one or more drive units (not shown) and one or more rotating or pivoting mechanisms that are controlled by a controller. As the figures show, the cutting arm (440) is configured to be positioned substantially above one of the base points (S1 and S2). The cutting arm (440) comprises a mounting shaft (441) at the top thereof, and a cutting tool (not numbered) is held at the bottom of the cutting arm (440) opposite to the mounting shaft. The cutting tool is configured to be positioned above and near the base point (S1), and can travel along a closed trajectory based on the movement of the cutting arm (440). The closed trajectory can pass through the base point (S1), so that the cutting tool can sever the just-formed spring from the wire (W) at the base point (S1). Generally, the cutting arm (440) is composed of a plurality of components, including a main support structure that constitutes the body of the cutting arm (440), various movable connecting mechanisms, a holder used for holding the cutting tool, a mounting shaft (441) having an eccentric structure, and one or more driving motors, and relevant descriptions of the components are omitted here for brevity. Thus, the cutting arm (440) will move in a particular manner, allowing the cutting tool to move along the closed trajectory, which can be changed by adjusting related mechanisms. In this embodiment, the cutting arm (440) can be mounted onto the mounting surface (410) of the machine body (40) by a lifting means. For example, a mounting groove (412) can be provided on the mounting surface (410) of the machine body (40) to receive a corresponding portion of the cutting arm (440) therein; the mounting groove (412) may also provide sufficient space that allows the cutting arm (440) to move up and down by known means. Though not shown in the figures, the cutting arm (440) can utilize a similar lifting mechanism to couple to the mounting surface (410) of the machine body (40) around the mounting shaft (441). With adjustments in the lifting/descending movement, the cutting arm (440) can longitudinally advance toward or retreat from the base point (S1), thereby allowing the cutting tool to be adjusted in a more flexible way.

Another cutting arm (450) is mounted below the base point (S1) and has a configuration similar to that of the cutting arm (440) described above. However, depending on the manufacturing strategies developed for the springs, the cutting tool of the cutting arm (450) can also be substituted by a tool with other functions, such as an auxiliary tool used for shaping a spring, for example a tool for forming spacing between spring coils.

FIGS. 7A and 7B further illustrate partial enlarged views of the embodiment, showing the processing tools keep away from and enter into one of the base points (the first base point S1), respectively. One or more coil spacing processing tools (424) may be provided between the output end of the wire guide member (420) and the base point (S1); each coil spacing processing tool extends obliquely and points toward the base point (S1). The coil spacing processing tool (424) has a special structure for forming a fixed spacing of the spring coil. The coil spacing processing tool (424) can also change the spacing size in the spring structure by controlling the distance between the coil spring processing tool and the base point (S1). In other words, the coil spacing processing tool (424) is a molding tool used for forming spacing between the spring coils.

As shown in the drawings, before the spring is completely formed, the cutting tool of the upper cutting arm (440) stays at a preparatory position. After the spring formation is completed, the cutting tool of the cutting arm (440) moves along the closed trajectory and proceeds to the base point (S1) to sever the just-formed spring from the wire. In addition, as mentioned above, the cutting tool of the lower cutting arm (450) can be replaced by another auxiliary tool, such as the above-described coil spacing processing tool, which proceeds to the base point (S1) during the formation of the spring to form desired spacing between spring coils. Certainly, in other embodiments, there can be only one coil spacing processing tool that is used during the formation of springs.

The upper and lower winding pins (4335) are positioned on the right side of the base point (S1) and point to the base point (S1) in a certain oblique direction. As FIG. 7A shows, the upper and lower mounting platforms (431) can be horizontally driven (in the X-axis direction as shown) and cause the winding pins (4335) to move away from the base point (S1). Depending on the spring structure, the upper and lower mounting platforms (431) are horizontally driven to move close to the base point (S1) respectively, with the processing tools (433) being driven to move concurrently. The mounting platforms (431) and the processing tools (433) keep moving until the tips of the winding pins (4335) are precisely positioned on the trajectory (the dotted line as shown) used for winding the wire, as shown in FIG. 7B. Generally, the angle between the upper and lower winding pins (4335) is 90 degrees, while the positions of the winding pins (4335) relative to the base point (S1) determine the diameter of the spring being formed. In this embodiment, instead of having the processing tools replaced to meet the needs for different spring sizes, the spring manufacturing machine can use digital data to control the distances between the upper, lower mounting platforms (431) and the base point (S1), and thereby determine the diameter of the spring. In addition, as there are multiple mounting locations defined by the multiple positioning holes (4316) on the mounting platforms (431), the locations for mounting the processing tools can be selected with more flexibility.

Different from the base point (S1) described above, another base point (the second base point S2) is also included in the machine of this embodiment for manufacturing other types of springs. The base point (S2) corresponding to a reserved space (460) is located between the other base point (S1) and the pair of movable assemblies (430). The two base points (S1 and S2) are located along the wire conveying direction and do not overlap with each other. As shown in FIGS. 7A and 7B, a reserved space (460) is provided between the base point (S1) on the mounting surface (the base point that the processing tools point to) and the upper and lower mounting platforms (410), configured for selectively mounting an additional processing tool. The reserved space (460) is located on the conveying direction of the wire guide member (420), so that the wire can proceed to the base point (S2) provided in the reserved space (460). In one example, a rotatable processing tool for making clock springs can be mounted on the reserved space (460) to receive the wire or sheet supplied from the output end of the wire guide member (420). The rotatable processing tool can then rotate and process the material to form a roll structure, and after the clock spring is formed, a cutting tool severs the spring from the material. Certainly, any suitable processing tool can be mounted onto the reserved space (460) depending on the type of spring to be formed, and the position of the base point (S2) can be adjusted depending on the selected processing tool.

The reserved space (460) and its corresponding base point (S2) are located between the upper and lower mounting platforms (431). The mounting platforms (431) of this embodiment are designed to partially surround the reserved space (460) and its corresponding base point (S2) without interfering with said base point (S2). When an operator of the machine chooses to use the reserved space (460) for making springs, the operator does not need to make extra efforts to adjust the movable assemblies already disposed on the machine, but only needs to mount a proper processing tool on the reserved space. Also referring to FIG. 3, the mounting platform (431) comprises a recess (4315) formed between the front end (4311) and the inner end (4314), and the recess is an indented part that is set further back than other peripheral parts of the mounting platform (431). The two recesses (4315) of the upper and lower mounting platforms (431) are configured to allow the reserved space (460) or its corresponding base point (S2), which is used for mounting a processing tool, to be exposed on the mounting surface (410) and avoid being covered by other components when the mounting platforms (431) move horizontally. As the figure shows, a portion of the recess (4315) extends substantially parallel to the conveying direction (i.e., the X-direction). Thus, the design of the mounting platforms according to this embodiment allows the processing tools to be mounted thereon to move laterally before a proper location for conducting spring processing is selected. Moreover, the mounting platforms provide two base point options for forming springs, and the two base points (S1 and S2) do not overlap with each other. In a word, the design according to this embodiment affords more flexibility in hardware configuration for spring manufacturing machines.

Figure 8A:
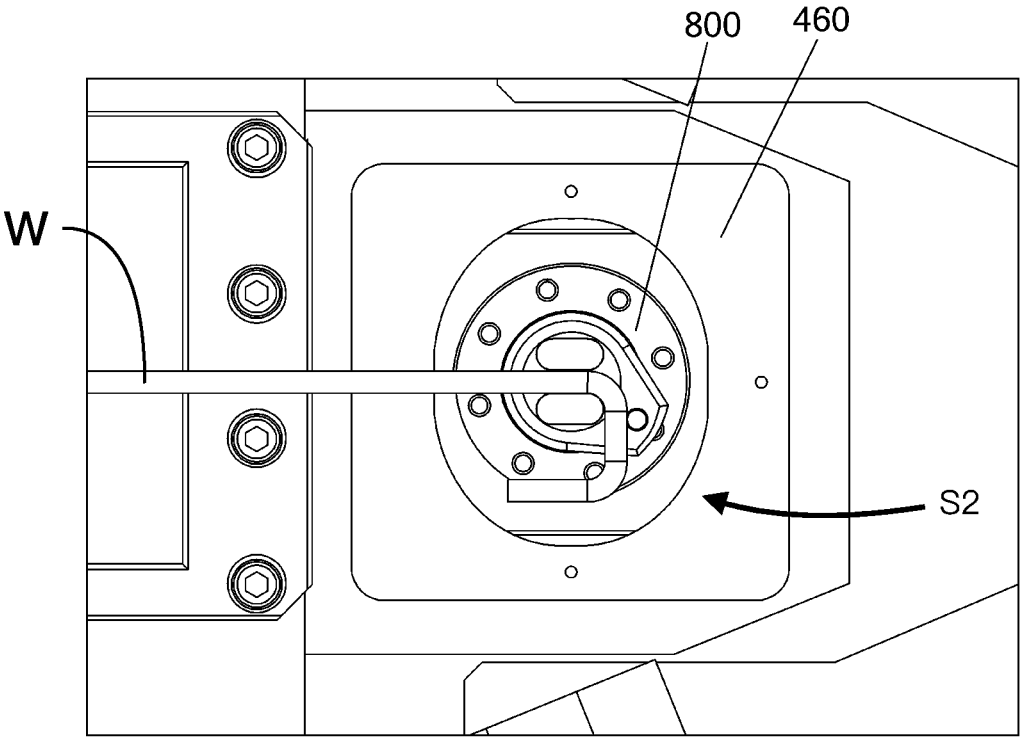
FIGS. 8A and 8B show another base point on the spring manufacturing machine from different perspectives.
Figure 8B:
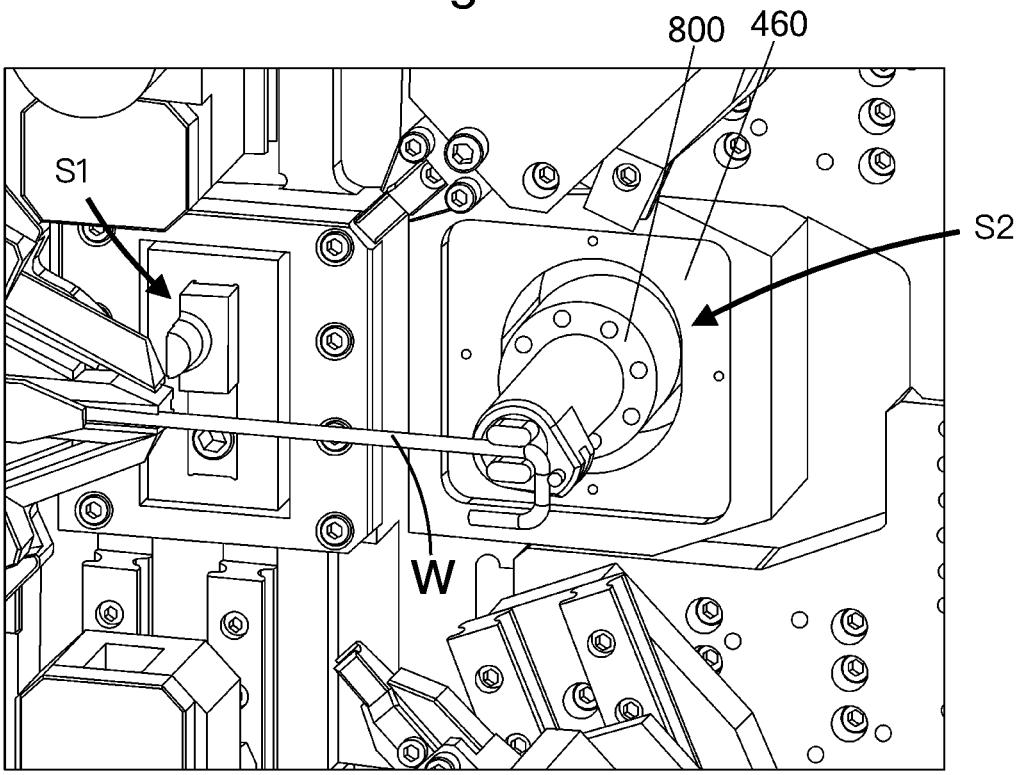

As stated above, FIGS. 8A and 8B show different views of the other base point (S2) provided by the spring manufacturing machine according to the present invention; the figures illustrate an additional processing tool (800) that is mounted on said reserved space (460). In this embodiment, the wire (W) proceeds from the wire guide member (420), across the first base point (S1, where another processing tool is removed or shifted away), and reaches a second base point (S2) to be held by the processing tool (800). In the illustrated example, the processing tool (800) that determines the second base point (S2) provides a rotating mechanism, which bends the wire (W) by a rotating movement and is suitable for making said clock springs or other bending structures. In some embodiments, other processing tools on the mounting platforms can move to the second base point (S2) to assist in the manufacture of springs. In addition, because the mounting platforms have recesses, regardless of how close the mounting platforms approach the second base point (S2), they would not interfere with any action performed at the second base point (S2). Preferably, when the mounting platforms are closest to the second base point (S2), their respective recesses will face each other while surrounding the second base point (S2).

Figure 9:
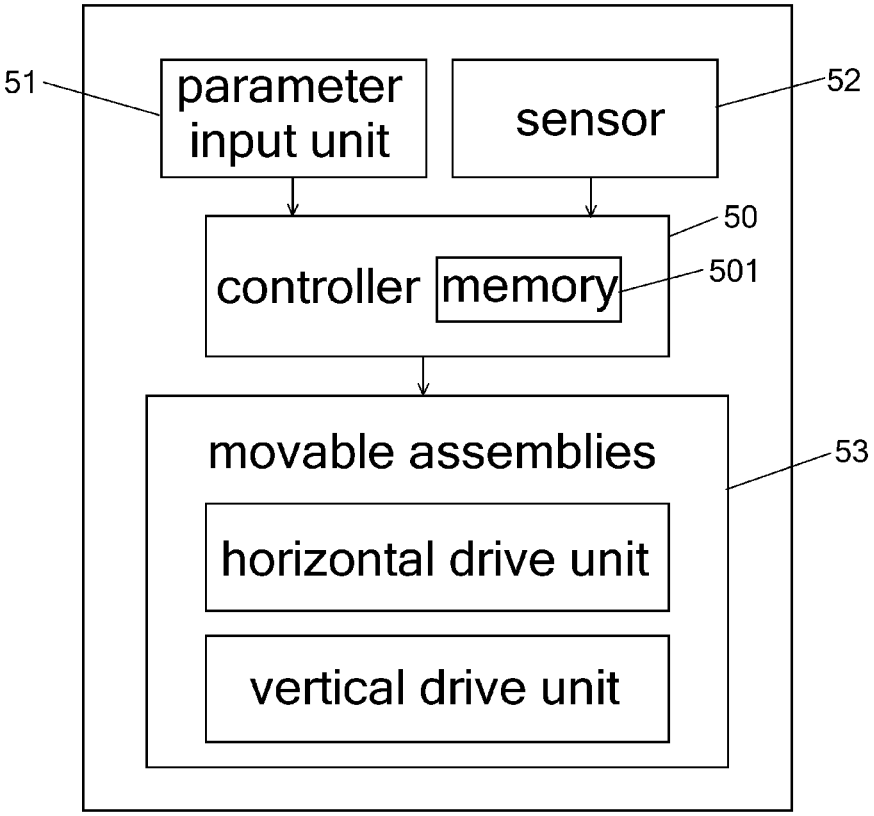
FIG. 9 is a block diagram of a spring manufacturing machine according to the present invention.

FIG. 9 is a block diagram of a spring manufacturing machine according to the present invention. The spring manufacturing machine according to the present invention can further include a control means for controlling movable mechanisms. As the figure shows, the spring manufacturing machine comprises a controller (50), which can be a single, physical processor that includes related operating software and one or more databases and applications. The controller (50) also comprises memory (501) for storing control commands and related control parameters. More specifically, the memory (501) can include machine-readable program code that can be executed by a computer, or may be a computer-readable storage medium for storing data tangibly or permanently. As used herein, memory (501) or a computer-readable storage medium refers to a tangible or physical storage medium (as opposed to signals), including but not limited to volatile, non-volatile, removable and non-removable mediums, which can be implemented by any method or technology to store data tangibly, or may be used for tangibly storing necessary information, data or commands for them to be accessed by a computer or a processor.

The controller (50) has one or more inputs and outputs, wherein the inputs are communicatively coupled to a parameter input unit (51). Typically, the parameter input unit (51) includes a user input interface, which allows the user to input various parameters and/or data for operating the spring manufacturing machine. The parameter input unit (51) can be a computer interface, including combinations of software and hardware, such as a monitor, keyboard, mouse, and graphical user interface, that can facilitate generation and transmission of signals. All the input parameters are stored in the memory (501) to allow the control commands to be executed according to one or more of the parameters. The parameters mainly contain those related to movement and positions of the machine parts, those related to the springs to be formed, and those related to the processing tools.

Parameters related to the moving range of the movable assemblies (430) and the mounting platforms (431) are referred to as shift parameters. As described above, the lateral (X-direction) track unit (432) according to an embodiment the present invention can define a lateral coordinate or coordinates in two dimensions (as the X, Y coordinates shown in the figure), thereby allowing the movement of the movable assemblies and the mounting platforms to be quantified and represented by parameters, which can be stored in the memory (501). For example, the coordinate system can be defined based on the resolution of the drive unit and applied to all the mounting locations and movement of the machine parts. The controller (50) controls the drive units that drive the movable assemblies and the mounting platforms based on the shift parameters. In other embodiments, the shift parameters may include parameters defined by coordinates in three dimensions, or parameters defined by other coordinate systems. The shift parameters can further include parameters related to the wire guide member (420), which are used to determine the motion scheme associated with the wire distance, such as the distance, speed and angle parameters for conveying the wire (W).

Figure 10:
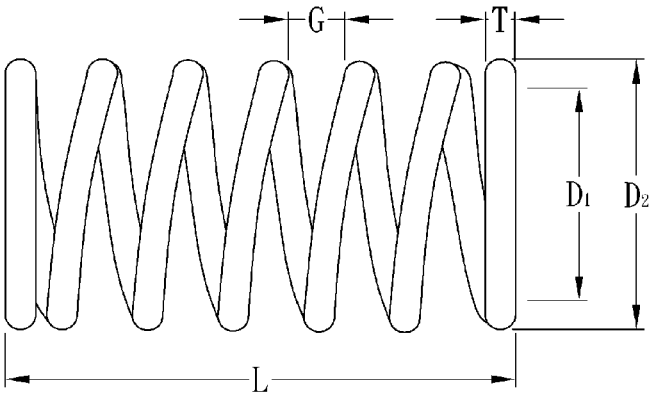
FIG. 10 shows a spring structure.

Parameters related to the springs to be formed can derive from the input structural data of a spring, including the type, material, and specifications of a spring. FIG. 10 shows the structure of a compression spring, and its structural data can include information about the wire diameter (T), inner diameter (D1) and outer diameter (D2) of the spring, length (L), pitch (G) and number of coils. Certainly, a spring manufacturing machine according to the present invention is not limited to producing compression springs; the structural data of other types of springs, such as tension springs and helical springs, are also applicable.

Parameters related to the processing tools represent information about the type and mounting location of each processing tool. That is to say, each type of processing tool typically has its own corresponding processing parameters, and as a processing tool is mounted on different mounting locations, additional processing parameters will be generated for that tool in accordance with its mounting location. The mounting location is determined by one or more positioning holes (4316). As described above, all positions can be defined by coordinates, and thus the location of each positioning hole can be converted into a parameter that is to be prestored in the memory (501). For example, the closed trajectory of the cutting arm (440) can also be converted into parameters based on a coordinate system. Of course, applicable parameters are not limited to the ones described above, more or fewer types of parameters may be included in the present invention.

The spring manufacturing machine can selectively include one or more sensors (52) configured to detect the condition of the spring being formed at the base point (S1). Typically, the sensor (52) is an optical sensor, such as a laser sensor, which can be mounted on the machine body (40) or the mounting platform (431) by a securing means; the sensor may project light to the base point (S1) in a proper direction, so that the motion of the processing tool relative to the base point (S1) can be detected and a detection signal can be generated accordingly. The controller (50) is configured to receive detection signals from the sensor (52) and determines whether to change the motion scheme for one or more movable mechanisms, such as the movable assemblies (430) or processing tools, or to stop the whole operation process based on the various stored parameters as described above. The motion scheme refers to the combination of moving direction, distance, orientation, speed and sequence for one or more movable assemblies or processing tools, which are controlled by the controller, with respect to a specific spring structure. In other words, the motion scheme describes all the actions performed by a single or all of the movable mechanisms during the process of forming a spring. Based on the processing performed by the controller (52), the sensor can generate a detection signal to determine the motion scheme for the processing tool or determine whether the spring formed is on the correct position, and thereby decide if calibration is required.

The output of the controller (50) outputs one or more control signals to the drive units, such as the horizontal (X-direction) motion drive unit and vertical (Y-direction) motion drive unit of the movable assemblies (53), based on the determined motion scheme. Accordingly, the spring manufacturing machine according to the present invention forms at least one spring structure during the time period from the beginning to the end of the motion scheme.

Figure 11:
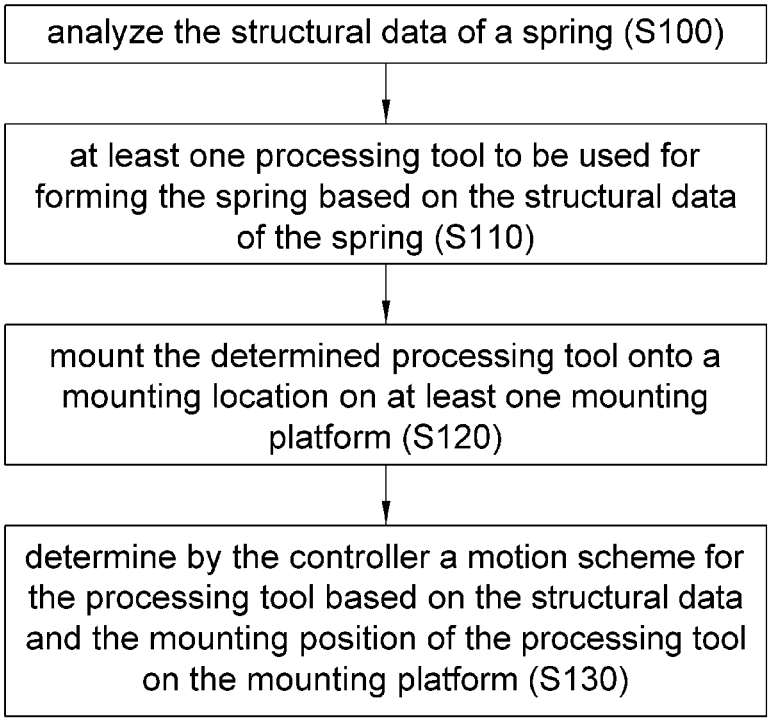
FIG. 11 is a flow chart showing a method of using the spring manufacturing machine according to the present invention.

FIG. 11 shows a method of using a spring manufacturing machine according to the present invention. The spring manufacturing machine includes at least the following parts as shown in FIG. 1: a machine body, a wire guide member that keeps guiding the wire to one of the base points (S1 and S2), a plurality of mounting platforms slidably mounted on a mounting surface of the machine body to partially surround one of the base points (S1 and S2), and a plurality of drive units that drive the corresponding mounting platforms. The method includes steps S100 to S130.

At Step S100, analyze the structural data of a spring. The structural data of a spring are generated according to the type, specific structure and specifications of the spring to be formed. Such data can be entered through a parameter input unit (51) as shown in FIG. 9 and stored in the memory (501) of a controller (50) before the manufacturing process begins. The structural data can be processed and converted to various parameters for determining the above-mentioned motion scheme. As shown in FIG. 10, the structural data of the spring can include multiple parameters related to the wire diameter (T), inside diameter (D1) of the spring, outside diameter (D2) of the spring, length (L), pitch (G) and the number of coils. For example, the controller (50) can determine the length of a wire that the wire guide member should carry forward based at least on the wire diameter (T), inside diameter (D1) and outside diameter (D2) of the spring, spring length (L), pitch (G) and the number of coils, and thereby precisely controls the corresponding drive units. Moreover, at Step S100, a starting point and an ending point of the spring structure are further determined through analysis, and a plurality of vectors between the starting point and the ending point are generated to represent a 3D shape of the spring structure. As the wire guide member (420) keeps guiding the wire to proceed to one of the base points (S1 and S2), the wire goes from the starting point to the ending point of the spring.

At Step S110, determine at least one processing tool to be used for forming the spring based on the structural data of the spring. The memory (501) of the controller (50) can prestore a spring database, which contains not only the structural data for various types of springs, but also data that further describe spring categories and processing tool options for each category. The options are generated based on the three-dimensional structure of the spring, and may include options for the size of a cutting tool, the shape of winding pins, and the size of a coil spacing processing tool, for example. The controller (50) thus conducts analysis and determines or recommends at least one processing tool based on the structural data or their corresponding parameters. The selection or decision on the processing tool can be demonstrated via a display interface. Furthermore, based on the movable assemblies mounted on the spring manufacturing machine, such as the movable assemblies (430) in FIG. 1, the controller (50) can determine at least one processing tool and even at least one mounting location of such tool on the movable assemblies based on the structural data of the spring to be formed.

In addition, based on the 3D structure of the spring represented by a plurality of vectors, every vector of the 3D spring structure from the starting point to the ending point will pass through the base point (S1) during the process when the wire guide member (420) keeps guiding a wire to proceed to the base point (S1). The controller (50) determines which processing tool should enter into the base point (S1) to contact the wire when a particular vector in a series reaches the base point (S1), and determines which processing tool should leave the base point (S1) when another particular vector in a series reaches the base point (S1). Also, the controller (50) determines a motion scheme for applying to the processing tool during the period that the processing tool is reaching/leaving the base point (S1). The motion scheme allows the processing tool to process the wire to form part of the 3D spring structure. When the last vector reaches the end point, the controller (50) gives a command to the cutter to cut off the wire, and thus the process of forming a spring is completed. Hence, after collecting data about the 3D structure of various types of springs and relevant manufacturing process data for the selected processing tools, the controller (50) can perform big data analytics using those manufacturing process data, and thereby establish a database that includes data indicating the applicable motion schemes for various processing tools to process the different parts of a 3D spring structure. Therefore, a spring manufacturing machine according to the present invention is capable of meeting the demands for intelligent manufacturing in industry 4.0, and can efficiently handle the planning of processes that involve multiple types in large quantities, multiple types in small quantities, or processing mixed types.

At Step S120, mount the determined processing tool onto a mounting location on at least one mounting platform. The operator of the spring manufacturing machine may mount at least one processing tool onto the spring manufacturing machine based on the result—at least one processing tool determined by the controller (50)—or at least one processing tool option determined by the controller (50) obtained from the previous step. If the result renders processing tool options, several processing tools serving different functions, such as guiding, positioning, rotating, bending or cutting, can be mounted onto different mounting locations on the corresponding mounting platforms (430) or in the reserved space (460). The mounting locations are defined by the positioning groove (4317) orientated in various directions and the positioning holes (4316, 4316A, 4316B) arranged in different patterns as shown in FIG. 3. The result from the previous step can further include one or more corresponding movable assemblies of the processing tools or mounting locations of such movable assemblies being determined. For example, a cutting processing tool that has been determined may comprise a corresponding upper cutting arm (440) or lower cutting arm (450) shown in FIG. 1 to be selected and mounted by the machine operator. In another example, the processing tool that has been determined is a mold or rotary processing tool specifically used for forming clock springs; in this situation, the processing tool will be mounted onto a corresponding mounting location/base point (i.e., the second base point S2) in the reserved space (460) as shown in FIGS. 7A and 7B, instead of the base point (i.e., the first base point S1) close to the output end of the wire guide member. In other words, when the controller determines at least one processing tool and/or the related mounting location in a result, it also determines a base point (S1 or S2) for forming the spring. Step S120 ends after the processing tool and its mounting location are confirmed. The confirmation result can be input to the controller via the parameter input unit (51) and then processed to become a number of parameters, which can be used for determining motion schemes and stored in the memory (501).

At Step S130, the controller (50), based at least on the structural data of the spring and the mounting location of the processing tool on the mounting platform, controls the corresponding drive units to drive the wire guide member, the movable assemblies, and the mounting platforms, etc., and determines a motion scheme for the at least one processing tool to process the wire at the base point to form the spring. The motion scheme refers to the combination of moving direction, distance, orientation, angle, speed and sequence of one or more movable assemblies, processing tools or other elements taking part in the manufacturing process and controlled by the controller (50), with respect to a particular spring structure. The input or confirmed structural data of the spring and the information about the at least one processing tool and its mounting location are converted into various parameters and stored in the memory (501). These parameters, together with the control commands stored in the memory (501), are used to set up a motion scheme that includes multiple actions or acts to be carried out. Related drive units in the spring manufacturing machine then sequentially drive the corresponding movable assemblies based on the motion scheme to obtain the product matching the structural data of the spring.

In one embodiment, the controller (50) can be configured to establish a product model to be stored in the memory (501) based at least on the parameters related to the structural data of a spring. Similarly, the controller (50) can be configured to establish a simulation model to be stored in the memory (501) based at least on the parameters related to the determined at least one processing tool and its mounting location. Furthermore, the controller (50) can determine if the currently arranged or selected processing tools and their mounting locations can result in successful manufacture of the spring, or determine if any adjustment is needed based on the product model and the simulation model (by comparing the similarity or conformity between them). Adjustments may include changing the mounting location or changing the type of a processing tool being used, for example.

The controller (50) can be configured to record position parameters related to the base points; the position of a base point can be a particular point or a certain area. The controller (50) can be configured to record shift parameters related to all the positioning holes in each mounting section of the mounting platform, with each positioning hole being associated with a corresponding shift parameter and different positioning holes having different parameters. If the shift parameters of the positioning holes are indicated as (X, Y) according to a two-dimensional coordinate system, then the parameters related to the processing tools can use similar indications. The controller (50) can be configured to receive and record one or more input parameters and determine the motion scheme for the at least one processing tool based on the input parameters; the input parameters are related to the type of a processing tool and its mounting location on the mounting platform. That is to say, the controller (50) will determine which actions should be performed by the corresponding movable assemblies based on the parameters defined for the processing tool itself and the positioning hole parameters of a mounting location, so that the processing tool can reach or leave the base point at proper timing. Accordingly, the controller (50) can determine the motion scheme for the at least one processing tool based on the positioning holes of the mounting platform onto which the processing tool is mounted. In addition, during a spring forming cycle, the position of a base point can be changed according to the motion scheme designed for the processing tool; the base point is not confined to a fixed position.

Figure 12:
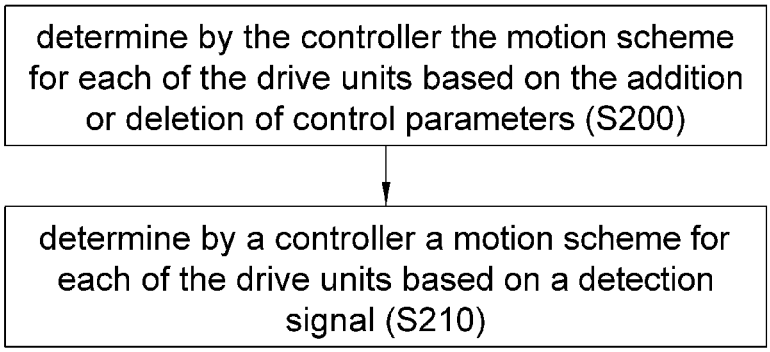
FIG. 12 is a flow chart showing further steps of the method of using the spring manufacturing machine according to the present invention.

In practice that involves using spring manufacturing machines, the operator may change the type and/or mounting location of a processing tool to satisfy different needs for manufacturing different types of springs, or may calibrate and adjust a processing tool and its related motion scheme to obtain an optimized motion scheme. Please refer to FIG. 12, which shows additional steps S200 and S210 included in a control method according to the present invention.

At Step S200, the controller (50) can be configured to determine the motion schemes for the drive units or processing tools based on addition and/or deletion of the control parameters. For example, if the mounting locations of one or more mounted processing tools need to be changed to meet the adjustment or calibration requirements of the spring manufacturing machine, the controller will delete the parameters associated with the current mounting locations of the processing tools first, and then add the parameters associated with the new mounting locations of the processing tools. In another example, if the mounting location of a processing tool remains unchanged but the processing tool needs to be replaced, the controller will delete the parameters associated with the original processing tool first, and then add the parameters associated with another processing tool. In other words, for these the changes of a processing tool, a mounting location, or even the structural data of a spring or the characteristics data of a wire, the controller will update the recorded parameters and determine a new motion scheme accordingly. The step is then finished.

Simulation can be applied to the new motion scheme, and thus the scheme can determine whether the spring manufacturing machine will manage to produce the spring as defined by the structural data. As mentioned above, by comparing the product model defined by the structural data of the spring with the simulated model defined by the motion scheme, the machine can determine whether all the parameters are optimized, and thereby ensure the accuracy of the spring product. Certainly, a spring manufacturing machine according to the present invention can also ensure the accuracy of the product by using a dynamic monitoring means. At Step S210, the controller (50) can be configured to determine a motion scheme for each of the drive units based on a detection signal. As FIG. 9 shows, the spring manufacturing machine according to the present invention can include one or more sensors (52), such as an optical sensor, for detecting the actions of the processing tools and the wire at the base point. If any unexpected deviation of the processing tool or the wire occurs at the base point, the sensor (52) would output a resulting detection signal. The controller (50) can be configured to receive and process the detection signal, and then modify the current motion scheme, determine a different motion scheme, or stop the manufacturing process based on the processing result.

In view of the above, it can be understood that a spring manufacturing machine according to the present invention can provide at least two selectable base point options for forming a spring. Regardless of which base point is selected, the special design of the movable assemblies according to the present invention can ensure that operation at any base point will not be interfered during the movement of processing. In other words, the operator can select a proper base point provided on the spring manufacturing machine as needed for the manufacturing process. The operator only needs to adjust the motion schemes for the movable assemblies, but does not need to rearrange the positions of the movable assemblies. In brief, the machine operator can select a proper base point for forming the spring depending on actual needs, while the movable assemblies of the machine remain unchanged.

The above description of various embodiments as provided concerning the claimed subject matter is for explanation and illustration purposes only, and is not intended to be comprehensive or limit the claimed subject matter to certain exact forms. One skilled in the art will readily appreciate that various modifications and variations of the present invention are possible. The embodiments are selected and described to best illustrate the subject of the present invention and the applications thereof, so that persons in related technical fields can understand the claimed subject matter, the various embodiments and improvements suitable for the specific use as contemplated.

What is claimed is:

1. A spring manufacturing machine with a mounting surface for mounting processing tools, comprising:

a wire guide member configured for guiding a wire along a conveying direction to one of a first space and a second space above the mounting surface for forming the spring, wherein the first space is configured to allow a first spring forming process, the second space is configured to allow a second spring forming process, the second space corresponds to a reserved space for mounting a processing tool for the second spring forming process; and a pair of movable assemblies mounted on the mounting surface so that the second space is located between the first space and the pair of movable assemblies, each of the pair of movable assemblies including a mounting platform configured to move toward and away from the first space and the second space along the conveying direction;

wherein each of the pair of movable assemblies has a recess, and the pair of movable assemblies are disposed side by side so that the second space is surrounded by the recesses, such that the pair of movable assemblies is configured to move without interfering with the second spring forming process provided at the second space, wherein said mounting platform has a front end, a rear end opposite to the front end and an inner end extending between the front end and the rear end, wherein the recess extends between the front end and the inner end, the inner end of each of the pair of movable assemblies is adjacent to the other inner end of the other one of the pair of movable assemblies, and the recess has a first edge extending from the front end parallel to the conveying direction and a second edge extending from the inner end perpendicular to the conveying direction.

2. The spring manufacturing machine as claimed in claim 1, wherein the first space and the second space are aligned with the conveying direction without overlap.

3. The spring manufacturing machine as claimed in claim 1, wherein the pair of movable assemblies is arranged in a symmetrical configuration with respect to the conveying direction of the wire guide member.

4. The spring manufacturing machine as claimed in claim 1, wherein the second space is located between the recesses of the mounting platforms.

5. The spring manufacturing machine as claimed in claim 1, wherein the mounting platform provides multiple mounting sections for selectively mounting processing tools thereon.

6. The spring manufacturing machine as claimed in claim 1, wherein the mounting platform has a positioning groove for mounting processing tools.

7. The spring manufacturing machine as claimed in claim 6, wherein the positioning groove extends between the front end and the inner end of the mounting platform.

8. The spring manufacturing machine as claimed in claim 6, wherein the positioning groove has a turning point that defines the positioning groove has sections with different extension.

* * * * *